US009957878B2

(12) United States Patent
Takahashi et al.

(10) Patent No.: US 9,957,878 B2
(45) Date of Patent: May 1, 2018

(54) COOLING SYSTEM FOR ENGINE

(71) Applicant: Mazda Motor Corporation, Aki-gun, Hiroshima (JP)

(72) Inventors: Kotaro Takahashi, Hiroshima (JP); Nobuo Yunoki, Aki-gun (JP); Masahiro Naito, Hiroshima (JP); Atsushi Yamada, Higashihiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 260 days.

(21) Appl. No.: 14/830,645

(22) Filed: Aug. 19, 2015

(65) Prior Publication Data

US 2016/0090898 A1 Mar. 31, 2016

(30) Foreign Application Priority Data

Sep. 25, 2014 (JP) ..... 2014-195506

(51) Int. Cl.
*F01P 7/02* (2006.01)
*F01P 7/00* (2006.01)
(Continued)

(52) U.S. Cl.
CPC ..... *F01P 7/167* (2013.01); *F02D 41/068* (2013.01); *F01P 2025/30* (2013.01);
(Continued)

(58) Field of Classification Search
CPC ..... F02M 25/0738; F02M 25/0703; F02M 25/0709; F02M 25/0728; F01P 3/20;
(Continued)

(56) References Cited

U.S. PATENT DOCUMENTS 6,568,356 B1 * 5/2003 Hayakawa ..... F01P 7/167 123/41.1
2004/0065275 A1 * 4/2004 Hayami ..... F01P 7/164 123/41.1
(Continued)

FOREIGN PATENT DOCUMENTS

JP 2010096020 A 4/2010
JP 2013224643 A 10/2013
JP 2014001646 A 1/2014

*Primary Examiner* — David Hamaoui
*Assistant Examiner* — Syed O Hasan
(74) *Attorney, Agent, or Firm* — Alleman Hall Creasman & Tuttle LLP

(57) ABSTRACT

A cooling system for an engine is provided. The cooling system includes coolant flow paths including a first flow path and a second flow path and where coolant circulates, a coolant pump for circulating the coolant within the coolant flow paths, a flow rate control valve for adjusting a flow rate of the coolant through the second flow path, a temperature detector for detecting a temperature of the coolant within the first flow path, a valve controller for adjusting an opening of the flow rate control valve based on the temperature detected by the temperature detector, and an output level determiner for determining an output level of the engine based on at least one of a fuel injection amount for the engine and an engine speed.

12 Claims, 10 Drawing Sheets

(51) Int. Cl.
*F01P 7/16* (2006.01)
*F02D 41/06* (2006.01)

(52) U.S. Cl.
CPC .... *F01P 2025/64* (2013.01); *F02D 2200/021* (2013.01); *F02D 2200/1002* (2013.01)

(58) Field of Classification Search
CPC .... F01P 7/14; F01P 2007/146; F01P 2060/00; F01P 3/12; F01P 7/167; F01P 2025/30; F01P 2025/64; F02D 41/068; F02D 2200/021; F02D 2200/1002
USPC ..... 123/41.05, 41.58; 60/605.2, 287, 599
See application file for complete search history.

(56) References Cited

U.S. PATENT DOCUMENTS

2009/0255488 A1* 10/2009 Shiobara ..... F01P 7/167
123/41.1
2012/0055663 A1* 3/2012 Onozawa ..... H05B 1/0236
165/266
2013/0333641 A1* 12/2013 Araki ..... F01P 9/02
123/41.02

* cited by examiner

COOLING SYSTEM FOR ENGINE

BACKGROUND

The present invention relates to a cooling system for an engine.

Conventionally, known cooling systems for vehicles form a plurality of coolant flow paths passing through an engine body (cylinder head or cylinder block) or auxiliary machinery (heater core, exhaust gas recirculation (EGR) device, etc.), and are provided with a flow rate control valve for controlling coolant flow rates of the respective coolant flow paths (e.g., JP2013-224643A). Such a cooling system restricts the flow of the coolant into the engine body via the flow rate control valve while the engine is being warmed up after a cold start so as to stimulate a temperature increase of the engine body. When the temperature of the coolant within the coolant path passing through the cylinder head is increased, the cooling system cancels the flow restriction of the coolant into the engine body so as to cool the engine body.

However, in the engine to which the cooling system of JP2013-224643A is applied, there is a time-lag until the temperature change of the cylinder head is reflected in the temperature change of the coolant. Therefore, the temperature of the cylinder head may excessively increase during the time-lag, and the cylinder head may be damaged.

SUMMARY

The present invention is made in view of the above situations and aims to provide a cooling system for an engine which can suppress an excessive increase in temperature of a cylinder head while still stimulating a temperature increase of the cylinder head after a cold start of the engine.

According to an aspect of the present invention, a cooling system for an engine is provided. The cooling system includes coolant flow paths, a coolant pump, a flow rate control valve, a temperature detector, a valve controller, and an output level determiner. The coolant flow paths include a first flow path and a second flow path and circulate coolant therethrough, the first flow path passing through a cylinder head of the engine, the second flow path branching from the first flow path and passing through auxiliary machinery of the engine. The coolant pump circulates the coolant within the coolant flow paths. The flow rate control valve adjusts a flow rate of the coolant through the second flow path. The temperature detector detects a temperature of the coolant within the first flow path. The valve controller adjusts an opening of the flow rate control valve based on the temperature detected by the temperature detector. The output level determiner determines an output level of the engine based on at least one of a fuel injection amount for the engine and an engine speed. The valve controller fully closes the flow rate control valve in a case where the detected temperature is below a predetermined temperature threshold and the determined output level is one of a reference output level and a value therebelow, and the valve controller opens the flow rate control valve in one of a case where the detected temperature is below the temperature threshold and the determined output level exceeds the reference output level, and a case where the detected temperature is one of the temperature threshold and a value thereabove.

According to this configuration, the output level of the engine is determined based on at least one of the fuel injection amount for the engine and the engine speed. A heat release rate of the engine increases as the output level of the engine becomes higher. Further, in the case where the detected temperature is below the predetermined temperature threshold and the determined output level is one of the reference output level or a value thereunder, in other words, when the heat release rate of the engine is low and the coolant flowing through the cylinder head has a low temperature, the opening of the flow rate control valve is adjusted to zero. Therefore, the flow rate of the coolant flowing through the cylinder head is restricted, and the temperature increase of the cylinder head is stimulated. Further, since the heat release rate of the engine is low, the temperature of the cylinder head does not excessively increase even with the restriction of the flow rate of the coolant flowing through the cylinder head.

On the other hand, in the case where the detected temperature is below the temperature threshold and the determined output level exceeds the reference output level, in other words, when the temperature of the coolant flowing through the cylinder head is still low despite the output level of the engine being higher and the heat release rate of the engine being higher, the flow rate control valve is opened. Thus, the coolant flows through the second flow path, the coolant flows into the cylinder head, and the coolant flow rate of the cylinder head increases.

Specifically, while the temperature of the coolant is low, the coolant flow rate of the cylinder head is only increased when the heat release rate of the engine is high. Therefore, even in a case of sharp acceleration immediately after the cold start of the engine or when the vehicle travels at a high speed, the excessive temperature increase of the cylinder head can be suppressed while stimulating the temperature increase of the cylinder head.

The valve controller preferably fully opens the flow rate control valve in a case where the detected temperature is below the temperature threshold and the determined output level exceeds the reference output level.

According to this configuration, since the flow rate control valve is fully opened, the coolant flow rate of the cylinder head can swiftly be increased to effectively suppress the excessive temperature increase of the cylinder head.

Further, the output level determiner preferably has an output level map in which ranges of the output level are defined based on parameters, and the output level determiner preferably determines the output level by referring to the output level map, the parameters being the fuel injection amount for the engine and the engine speed.

According to this configuration, since the output level determiner determines the output level by referring to the output level map, the output level can comparatively easily be determined.

Further, the output level determiner preferably determines that the output level is one of the reference output level and a value therebelow in a case where the fuel injection amount for the engine is below a predetermined fuel injection amount threshold, and the output level determiner preferably determines that the output level exceeds the reference output level in a case where the fuel injection amount for the engine is one of the fuel injection amount threshold and a value thereabove.

The heat release rate of the engine becomes higher as the fuel injection amount becomes larger. Therefore, by determining the output level of the engine based on whether the fuel injection amount is below the fuel injection amount threshold, the output level can accurately be determined.

The output level determiner preferably determines that the output level exceeds the reference output level in a case where the fuel injection amount continuously exceeds the fuel injection amount threshold for a predetermined period of time, and the output level determiner preferably determines that the output level is one of the reference output level and a value therebelow in one of a case where the fuel injection amount is below the fuel injection amount threshold, and a case where a period of time for which the fuel injection amount continuously exceeds the fuel injection amount threshold is shorter than the predetermined time period.

According to this configuration, the output level determiner determines that the output level exceeds the reference output level in the case where the fuel injection amount continuously exceeds the fuel injection amount threshold for the predetermined time period, and the output level determiner determines that the output level is one of the reference output level and a value therebelow in the case where the period of time for which the fuel injection amount continuously exceeds the fuel injection amount threshold is shorter than the predetermined time period. Specifically, the output level determiner determines that the output level exceeds the reference output level only in the case where the fuel injection amount continuously exceeds the fuel injection amount threshold for a certain period of time. Therefore, unnecessary cooling of the cylinder head due to an increase of the coolant flow rate of the cylinder head can be prevented in a case where the fuel injection amount is momentarily increased, for example.

The output level map preferably includes a first range including the reference output level and a second range above the first range, and within a range of the output level map where the engine speed exceeds a predetermined value, the boundary between the first and second ranges preferably extends such that the fuel injection amount gradually decreases as the engine speed increases.

The heat release rate of the engine per unit time increases as the engine speed increases. Therefore, in the output level map, as long as the boundary between the first range including the reference output level and the second range above the first range extends such that the fuel injection amount gradually decreases as the engine speed increases, the flow rate control valve is swiftly opened at the high engine speed side and the excessive temperature increase of the cylinder head can effectively be suppressed.

The coolant flow paths preferably also include a third flow path passing through a cylinder block of the engine. The flow rate control valve preferably adjusts the flow rate of the coolant through the second and third flow paths. The valve controller preferably fully closes the flow rate control valve to the third flow path in one of a case where the detected temperature is below the temperature threshold and the determined output level is one of the reference output level and a value therebelow, and a case where the detected temperature is below the temperature threshold and the determined output level is within a range exceeding the reference output level and below a predetermined output level that is above the reference output level, and the valve controller preferably opens the flow rate control valve to the third flow path in one of a case where the detected temperature is below the temperature threshold and the determined output level is one of the predetermined output level and a value thereabove, and a case where the detected temperature is one of the temperature threshold and a value thereabove.

According to this configuration, after the output level of the engine reaches the reference output level and the coolant is started to be flowed into the second flow path, when the output level of the engine further increases to reach the predetermined output level, the flow rate control valve is opened to the third flow path. Therefore, the cylinder block can be cooled. Thus, the heat amount transferred from the cylinder block to the cylinder head can be reduced and the excessive temperature increase of the cylinder head can effectively be suppressed.

The flow rate control valve is preferably a rotary valve for increasing the flow rate of the coolant by increasing an opening thereof.

According to this configuration, since the rotary valve for increasing the flow rate of the coolant by increasing the opening thereof is applied, the flow rate can easily be controlled.

DETAILED DESCRIPTION OF EMBODIMENT

Hereinafter, one preferred embodiment of the present invention is described in detail with reference to the appended drawings.

First, an engine 9 and an intake-and-exhaust system thereof according to this embodiment are described.

The engine 9 is a diesel engine for driving a vehicle.

Figure 1:
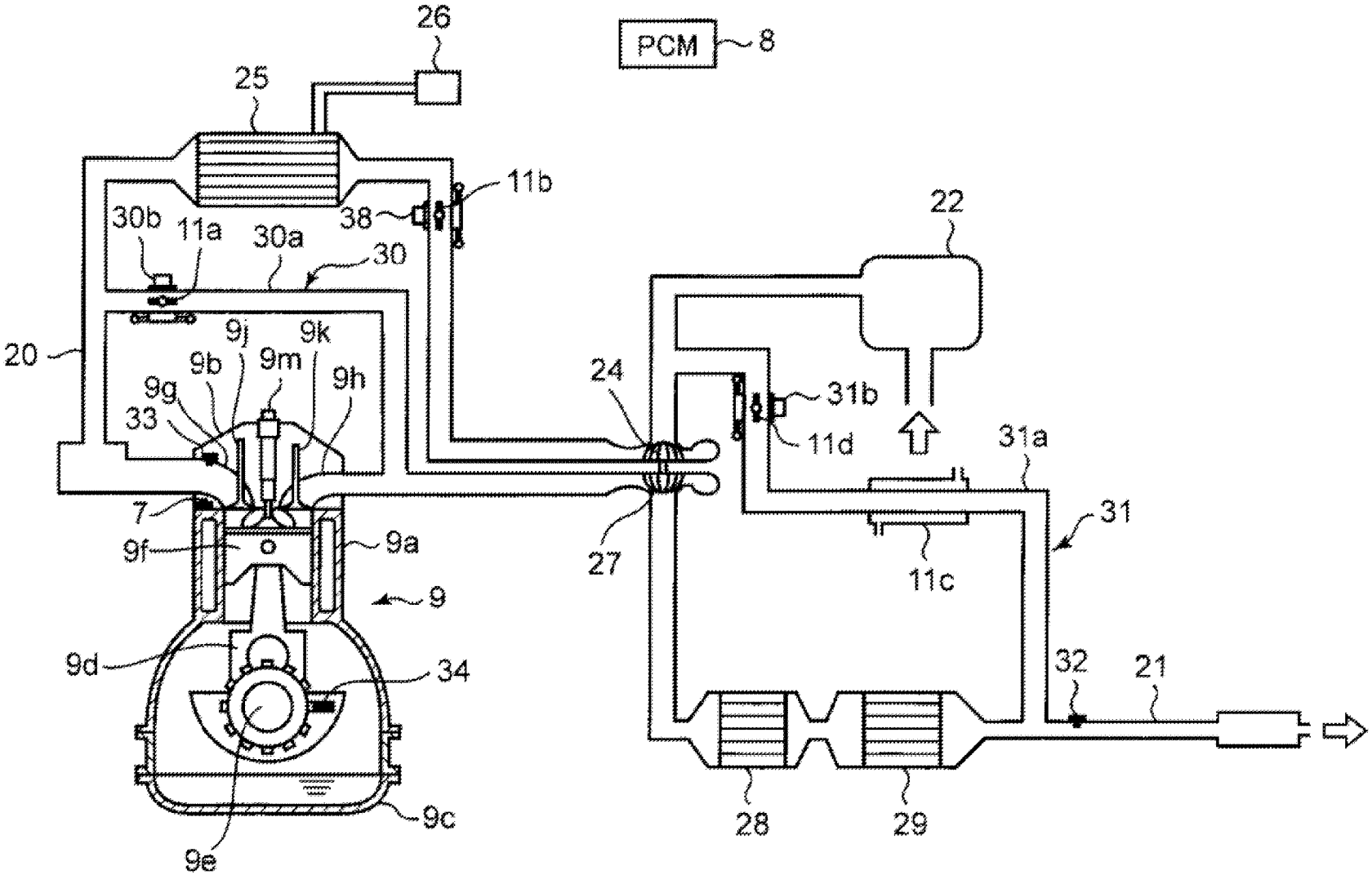
FIG. 1 is a view illustrating an engine and an intake-and-exhaust system according to an embodiment of the present invention.

The engine 9 includes a cylinder block 9*a* formed with a plurality of cylinders (only one cylinder is illustrated in FIG. 1), a cylinder head 9*b* disposed on the cylinder block 9*a*, and an oil pan 9*c* disposed below the cylinder block 9*a*.

A piston 9*f* coupled to a crankshaft 9*e* via a connecting rod 9*d* is reciprocatably fitted into each of the cylinders.

In the cylinder head 9*b*, an intake port 9*g* and an exhaust port 9*h* are formed for each of the cylinders. An intake valve 9*j* and an exhaust valve 9*k* are disposed at the intake and exhaust ports 9*g* and 9*h*, respectively.

Further, the cylinder head 9*b* is provided with electromagnetic-type direct injectors 9*m* for injecting fuel into the respective cylinders. The fuel is supplied to the direct injectors 9*m* from a fuel tank via a fuel pump and a common rail (none of which are illustrated). The common rail is provided with a fuel pressure sensor 36 (see FIG. 2) for detecting a pressure of the fuel.

The intake-and-exhaust system of the engine 9 includes an intake passage 20 for introducing intake air into the cylinders via the intake ports 9*g*, and an exhaust passage 21 for discharging outdoors exhaust gas produced within the cylinders.

The intake passage 20 is provided, in the following order from the upstream side, with an air cleaner 22 for removing dust contained within the intake air, a compressor 24 of a turbocharger, an intake shutter valve 11*b* for shutting down the intake passage 20, an intake shutter valve actuator 38 for driving the intake shutter valve 11*b*, an intercooler 25 for forcibly cooling the intake air at high pressure and temperature due to being compressed by the compressor 24, and an intercooler coolant pump 26 for sending coolant to the intercooler 25.

The exhaust passage 21 is provided with, in the following order from the upstream side, an exhaust turbine 27 of the turbocharger, a diesel oxidation catalyst (DOC) 28, a diesel particulate filter (DPF) 29 for capturing exhaust particulate matter within the exhaust gas, etc.

Further, the intake-and-exhaust system includes a high-pressure exhaust gas recirculation (EGR) device 30 and a low-pressure EGR device 31.

The high-pressure EGR device 30 includes a high-pressure EGR passage 30*a* connecting a position of the intake passage 20 upstream of the intake ports 9*g* with a position of the exhaust passage 21 downstream of the exhaust ports 9*h*, a high-pressure EGR valve 11*a* for adjusting a flow rate of high-pressure EGR gas through the high-pressure EGR passage 30*a*, and a high-pressure EGR valve actuator 30*b* for driving the high-pressure EGR valve 11*a*.

The low-pressure EGR device 31 includes a low-pressure EGR passage 31*a* connecting a position of the exhaust passage 21 downstream of the DPF 29 with a position of the intake passage 20 upstream of the compressor 24, a low-pressure EGR valve 11*d* for adjusting a flow rate of low-pressure EGR gas through the low-pressure EGR passage 31*a*, a low-pressure EGR valve actuator 31*b* for driving the low-pressure EGR valve 11*d*, and a low-pressure EGR cooler 11*c* for cooling the low-pressure EGR gas.

The engine 9 and the intake-and-exhaust system configured as above are controlled by a powertrain control module (PCM) 8. The PCM 8 is comprised of a CPU, at least one memory, an interface, etc.

Figure 2:
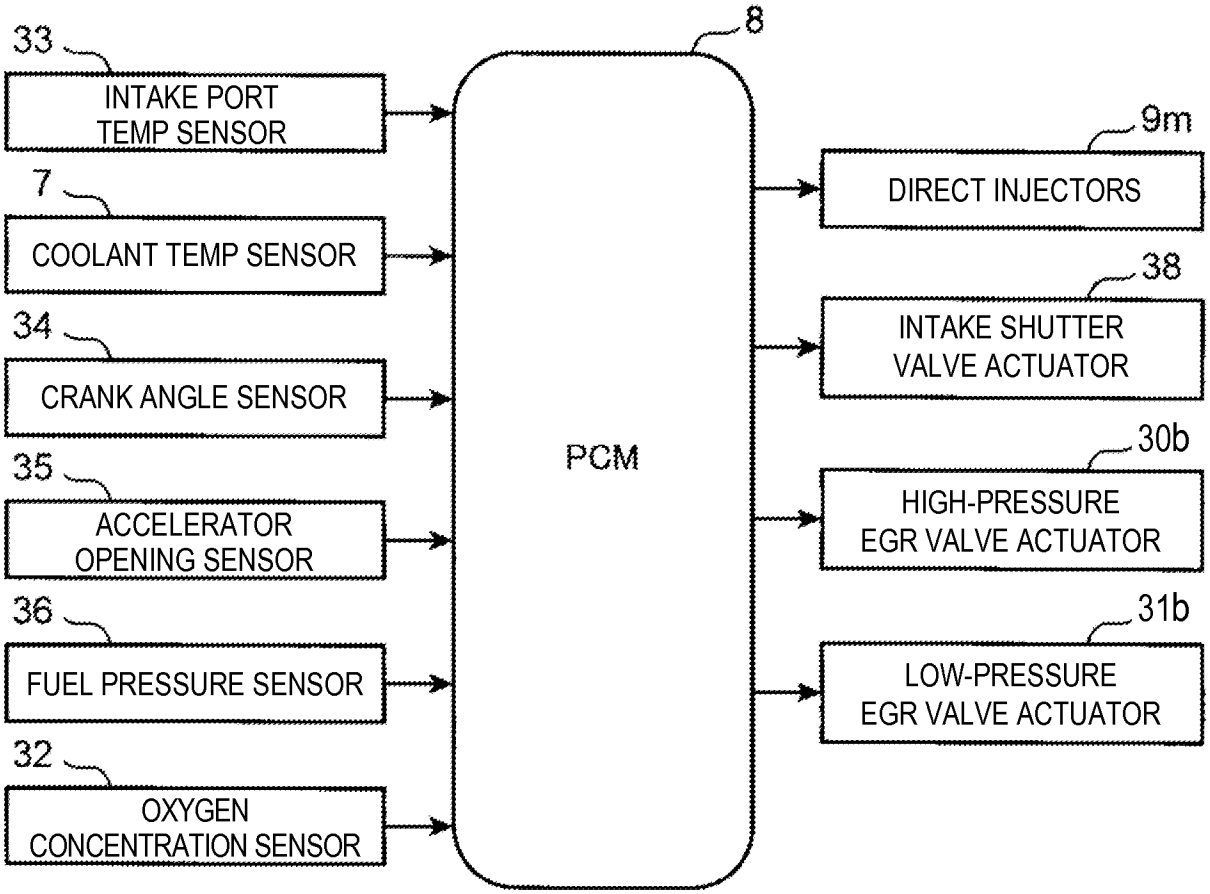
FIG. 2 is a view illustrating a PCM, an input unit, and an output unit according to the embodiment of the present invention.

As illustrated in FIG. 2, the PCM 8 receives detection signals of various sensors. The various sensors include intake port temperature sensors 33 attached to the intake ports 9*g* and for detecting temperatures of the intake air immediately before flowing into the respective cylinders (intake mixture containing intake air and exhaust gas), a coolant temperature sensor 7 for detecting a temperature of the coolant near the intake ports 9*g*, a crank angle sensor 34 for detecting a rotational angle of the crankshaft 9*e*, an accelerator opening sensor 35 for detecting an accelerator opening corresponding to an operation amount of an acceleration pedal (not illustrated) of the vehicle, the fuel pressure sensor 36 for detecting the fuel pressure to be supplied to the direct injectors 9*m*, and an oxygen concentration sensor 32 for detecting an oxygen concentration within the exhaust gas at a position downstream of the DPF 29.

The PCM 8 determines states of the engine 9, the intake-and-exhaust system and the like by performing a variety of operations based on the detection signals of the sensors, and outputs control signals to the direct injectors 9*m* and the actuators of the various valves (intake shutter valve actuator 38, high-pressure EGR valve actuator 30*b*, low-pressure EGR valve actuator 31*b*) according to the determination result (engine control function and intake-and-exhaust system control function).

Figure 3:
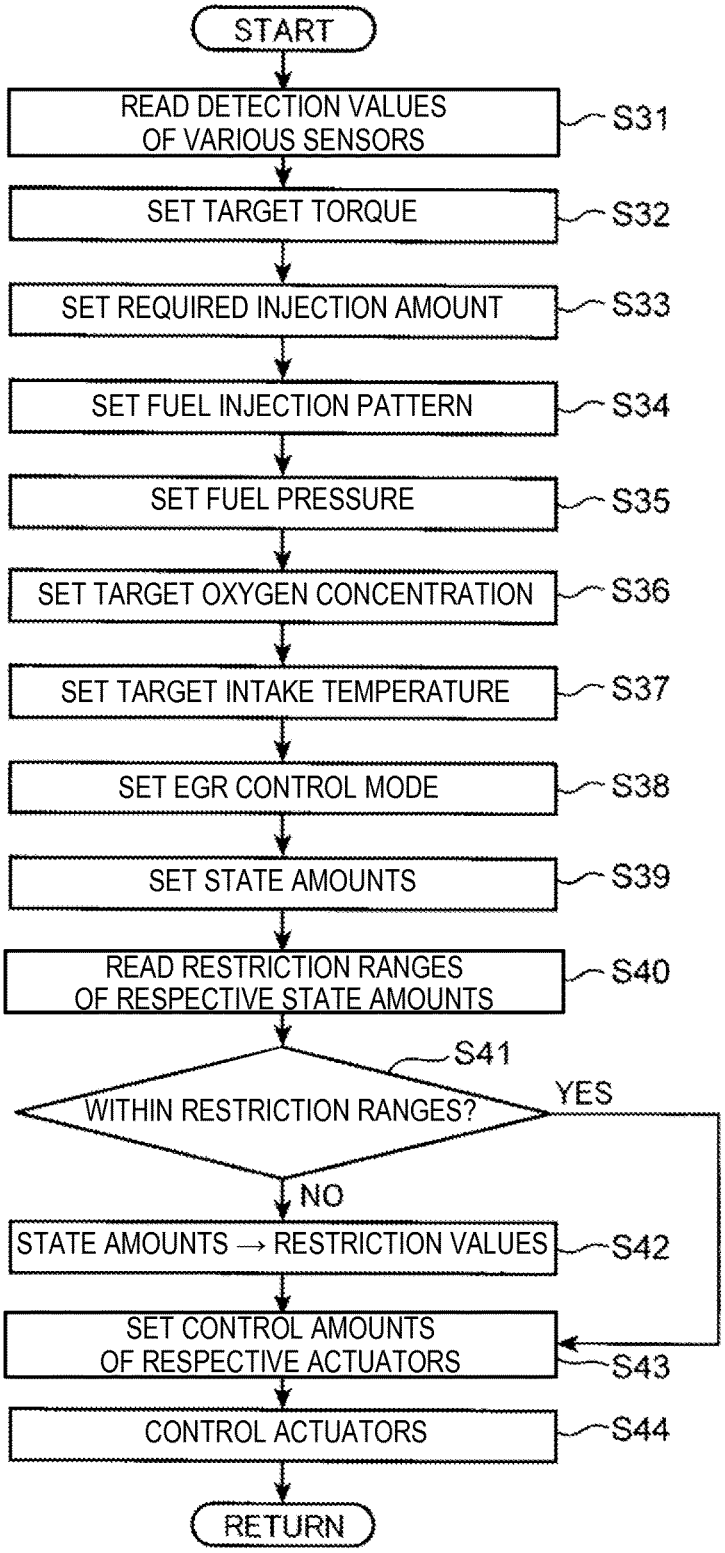
FIG. 3 is a flowchart illustrating a control of the intake-and-exhaust system of the engine according to the embodiment of the present invention.

Next, a control performed by the PCM 8 is described with reference to the flowchart of FIG. 3.

First, the PCM 8 reads the detection values of the various sensors (S31).

Subsequently, the PCM 8 calculates an engine speed based on the rotational angle detected by the crank angle sensor 34, and sets a target torque based on the engine speed and the accelerator opening detected by the accelerator opening sensor 35 (S32).

Next, the PCM 8 sets a required injection amount of fuel based on the engine speed and the target torque (S33).

Then, the PCM 8 selects a fuel injection pattern according to the required injection amount and the engine speed, from a plurality of fuel injection patterns stored in the memory beforehand (S34).

Subsequently, the PCM 8 sets a fuel pressure to be supplied to the direct injectors 9*m*, based on the required injection amount and the engine speed (S35).

Next, the PCM 8 sets a target oxygen concentration based on the required injection amount and the engine speed (S36). The target oxygen concentration is a target value of an oxygen concentration of the intake mixture immediately before flowing into the cylinders.

Then, the PCM 8 sets a target intake temperature based on the required injection amount and the engine speed (S37). The target intake temperature is a target value of a temperature of the intake mixture immediately before flowing into the cylinders.

Subsequently, the PCM 8 selects an EGR control mode according to the required injection amount and the engine speed, from a plurality of EGR control modes stored in the memory beforehand (S38). The EGR control mode is respectively selected for the high-pressure and low-pressure EGR devices 30 and 31.

Next, the PCM 8 sets state amounts (high-pressure EGR amount, low-pressure EGR amount, and turbocharging pressure) for achieving the target oxygen concentration and the target intake temperature (S39).

Then, the PCM 8 reads restriction ranges of the respective state amounts from the memory (S40). The restriction ranges are ranges which the state amounts need to meet (remain within), respectively, so that the engine 9 and the intake-and-exhaust system can suitably operate, and the restriction ranges are stored in the memory beforehand.

Subsequently, the PCM 8 determines whether the state amounts set at S39 are within the restriction ranges, respectively (S41).

If the state amounts are determined to be within the restriction ranges, respectively (S41: YES), the control proceeds to S43, where the PCM 8 sets control amounts of the direct injectors 9*m*, the intake shutter valve actuator 38, the high-pressure EGR valve actuator 30*b*, and the low-pressure EGR valve actuator 31*b* based on the state amounts set at S39, respectively.

Next, the PCM 8 controls the direct injectors 9*m*, the intake shutter valve actuator 38, the high-pressure EGR valve actuator 30*b*, and the low-pressure EGR valve actuator 31*b* based on the set control amounts, respectively (S44).

At S41, if any of the state amounts is determined to be out of the corresponding restriction range, the PCM 8 corrects the state amount to the corresponding restriction range (S42). For example, the PCM 8 corrects the state amount to a restriction value closest to the state amount set at S39 within the restriction range. After S42, the PCM 8 controls the direct injectors 9*m*, the intake shutter valve actuator 38, the high-pressure EGR valve actuator 30*b*, and the low-pressure EGR valve actuator 31*b* based on the corrected state amount (S44).

Hereinafter, the cooling system of the engine 9 according to this embodiment of the present invention is described.

Figure 4:
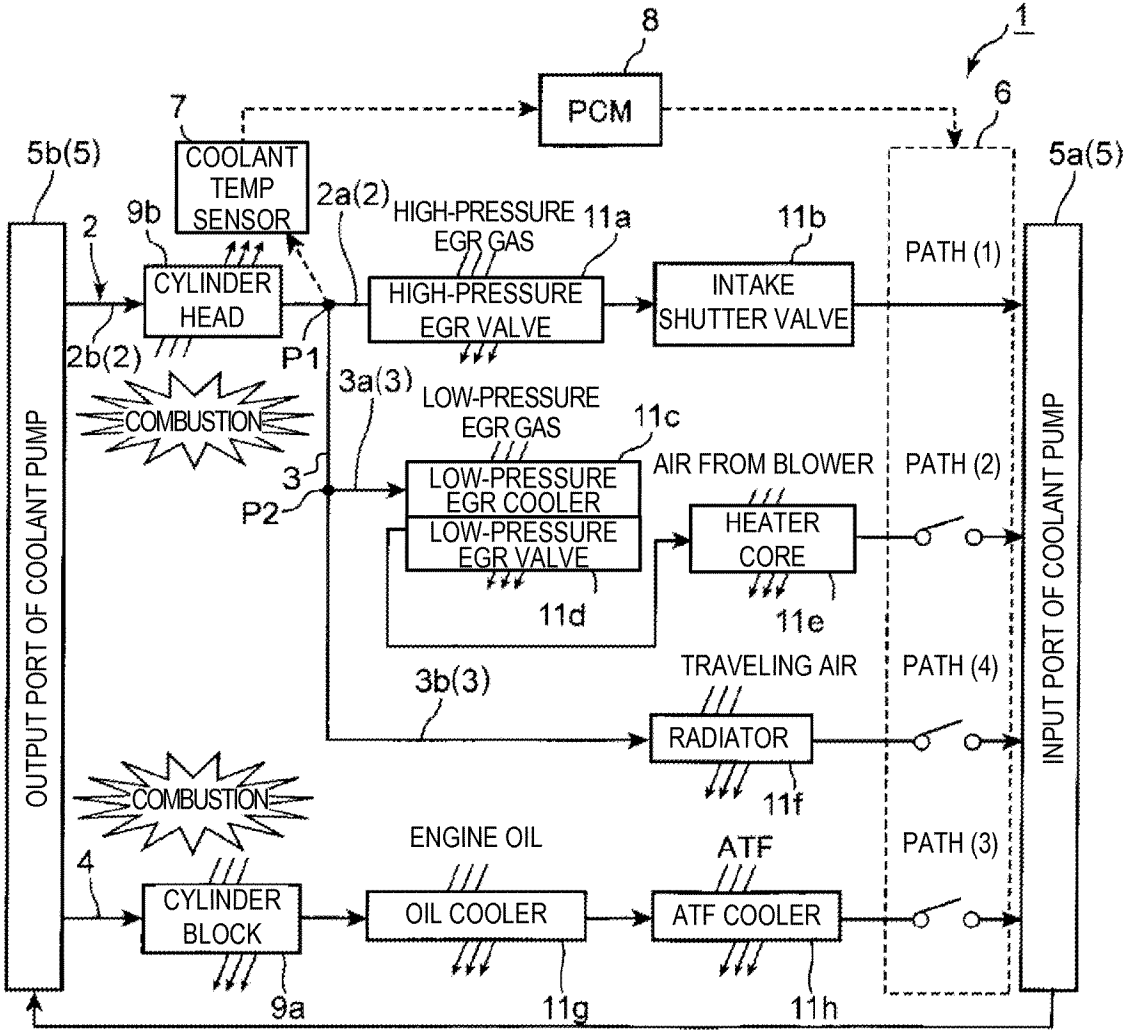
FIG. 4 is a view illustrating a cooling system of the engine according to the embodiment of the present invention.

As illustrated in FIG. 4, the cooling system 1 of the engine 9 includes coolant flow paths having a first flow path 2, a second flow path 3, and a third flow path 4, a coolant pump 5, a flow rate control valve 6, the coolant temperature sensor 7, and the PCM 8. The coolant circulates within the coolant flow paths.

The first flow path 2 passes through the cylinder head 9*b* of the engine 9. The first flow path 2 has a branch point P1 toward the second flow path 3 at a position downstream of the cylinder head 9*b*. The first flow path 2 has a first auxiliary flow path 2*a* (path (1)) at a position downstream of the branch point P1. The first auxiliary flow path 2*a* passes through the high-pressure EGR valve 11*a* and the intake shutter valve 11*b*.

The second flow path 3 passes through auxiliary machinery such as components 11*a*-11*f* of the engine 9. The second flow path 3 has a branch point P2 at a position downstream of the branch point P1. The second flow path 3 has a second auxiliary flow path 3*a* (path (2)) and a third auxiliary flow path 3*b* (path (4)), both connected with the branch point P2. The second and third auxiliary flow paths 3*a* and 3*b* are connected in parallel with each other at the branch point P2.

The second auxiliary flow path 3*a* passes through the low-pressure EGR valve 11*d*, the low-pressure EGR cooler 11*c*, and a heater core 11*e*.

The third auxiliary flow path 3*b* passes through a radiator 11*f*.

The third flow path 4 (path (3)) passes through the cylinder block 9*a* of the engine 9, an oil cooler 11*g*, and an automatic transmission fluid (ATF) cooler 11*h*.

The coolant pump 5 is a turbopump and structured such that an impeller thereof is indirectly coupled to the crankshaft 9*e* of the engine 9. An input port 5*a* of the coolant pump 5 is connected with a downstream end of the first auxiliary flow path 2*a*, a downstream end of the second auxiliary flow path 3*a*, a downstream end of the third auxiliary flow path 3*b*, and a downstream end of the third flow path 4, via the flow rate control valve 6. An output port 5*b* of the coolant pump 5 is connected with an upstream end of the first flow path 2 and an upstream end of the third flow path 4.

The coolant pump 5 sucks, via the input port 5*a*, the coolant within the first to third auxiliary flow paths 2*a*, 3*a*, and 3*b* and the third flow path 4 by pumping in accordance with the rotation of the impeller using a part of engine torque, and discharges the coolant to the first and third flow paths 2 and 4, via the output port 5*b*. The coolant sucked into the coolant pump 5 is mixed inside the coolant pump 5 before being discharged.

The flow rate control valve 6 is a single rotary valve. The flow rate control valve 6 has a cylindrical casing, a cylindrical valve body rotatably contained inside the casing, and an actuator for rotating the valve body in a single direction. The actuator rotates the valve body based on the control signals (drive voltage) inputted from the PCM 8. Four input ports and four output ports are formed in a side surface of the casing. The four input ports are connected with the downstream ends of the first to third auxiliary flow paths 2*a*, 3*a*, and 3*b* and the third coolant flow path 4, respectively. The four output ports are connected with the input port 5*a* of the coolant pump 5.

Notched portions are formed in the side surface of the valve body. Communication areas S formed between the notched portions and the output ports of the casing are individually set for the first to third auxiliary flow paths 2*a*, 3*a*, and 3*b* and the third flow path 4. In the following description, the communication area S for the first auxiliary flow path 2*a* is referred to as "the communication area S2*a*," the communication area S for the second auxiliary flow path 3*a* is referred to as "the communication area S3*a*," the communication area S for the third auxiliary flow path 3*b* is referred to as "the communication area S3*b*," and the communication area S for the third flow path 4 is referred to as "the communication area S4."

The communication area S2*a* is stable at a small area near zero regardless of a rotational angle of the valve body (see FIG. 5), which can control the flow rate of the coolant to be as small as around zero so that the cylinder head 9*b* is not overcooled, while also securing a flow rate required for cooling the high-pressure EGR valve 11*a* and the intake shutter valve 11*b*.

Figure 5:
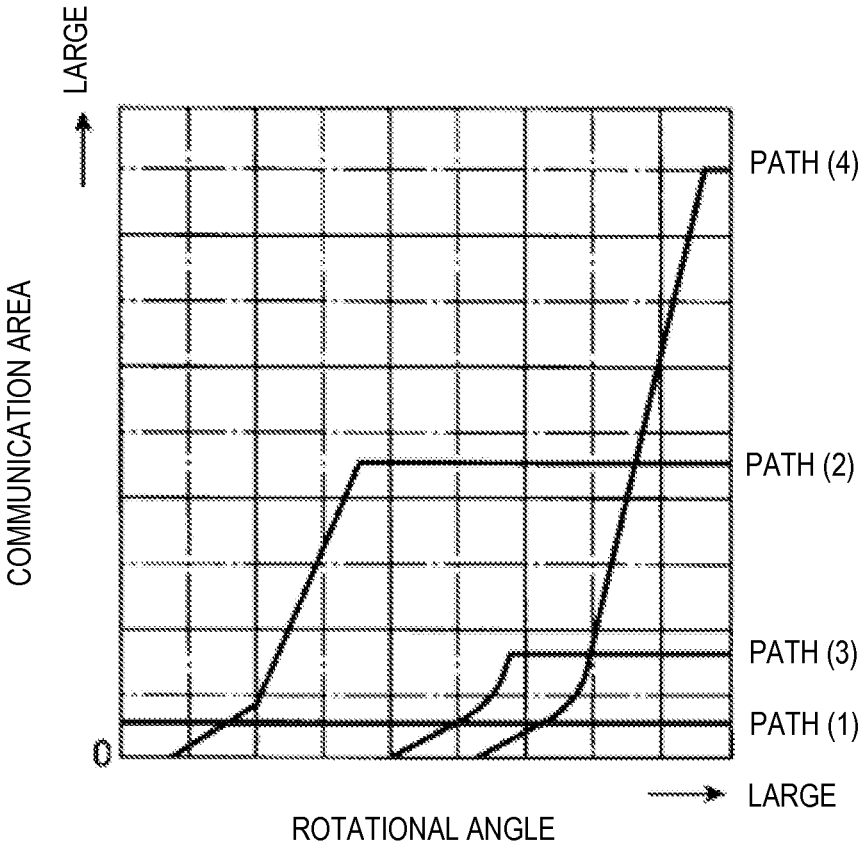
FIG. 5 is a chart illustrating relationship of a rotational angle with openings (communication areas) of a flow rate control valve according to the embodiment of the present invention.

On the other hand, the communication areas S3*a*, S3*b*, and S4 vary according to the rotational angle of the valve body (see FIG. 5).

In other words, the flow rate of the coolant through the second auxiliary flow path 3*a* is changed according to the variation of the communication area S3*a* (hereinafter, referred to as "the opening of the flow rate control valve 6 with respect to the second auxiliary flow path 3*a*").

Further, the flow rate of the coolant through the third auxiliary flow path 3*b* is changed according to the variation of the communication area S3*b* (hereinafter, referred to as "the opening of the flow rate control valve 6 with respect to the third auxiliary flow path 3*b*").

Further, the flow rate of the coolant through the third flow path 4 is changed according to the variation of the communication area S4 (hereinafter, referred to as "the opening of the flow rate control valve 6 with respect to the third flow path 4").

The coolant temperature sensor 7 detects the temperature of the coolant at a position of the first flow path 2, near the cylinder head 9*b*. The information of the temperature detected by the coolant temperature sensor 7 is transmitted to the PCM 8.

The PCM 8 has, in addition to the engine control function and intake-and-exhaust control function described above, an output level determining function to determine an output level of the engine 9, and a valve control function to control the openings of the flow rate control valve 6 based on the determination result of the output level and the temperature detected by the coolant temperature sensor 7.

First, the method of determining the output level of the engine 9 is described with reference to FIGS. 6 and 7.

Figure 6:
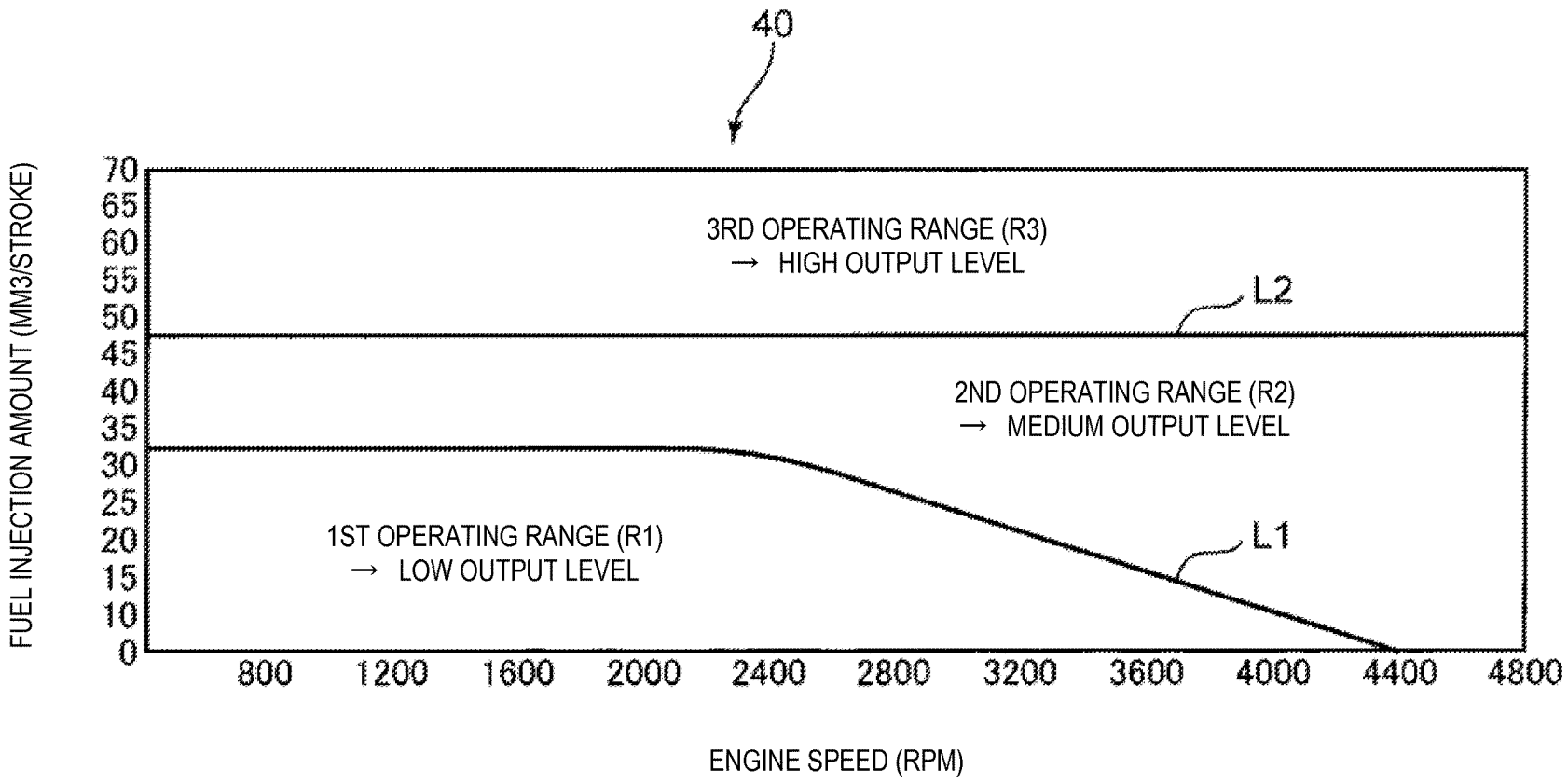
FIG. 6 is a map used in determining an output level of the engine according to the embodiment of the present invention.
Figure 7:
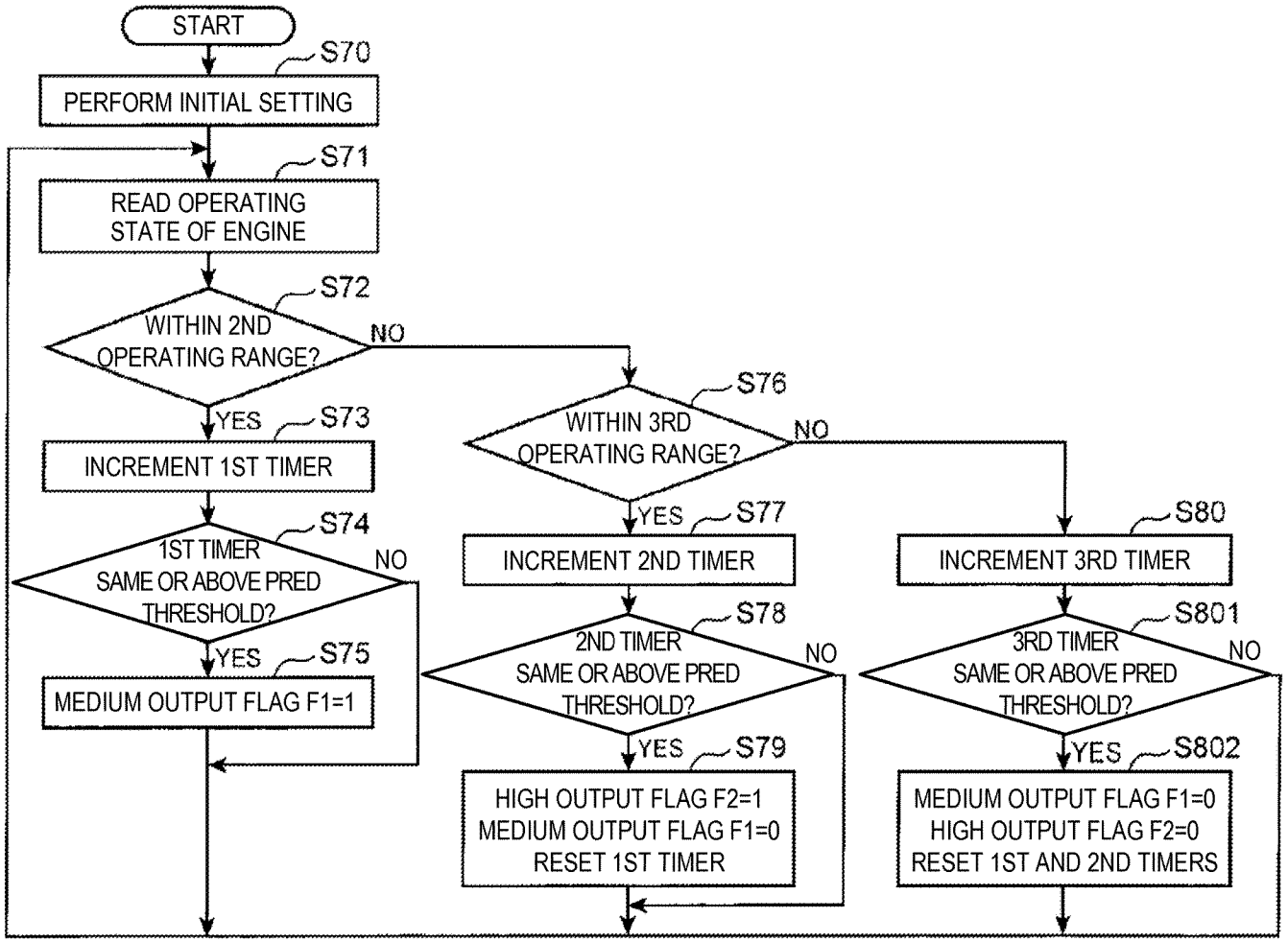
FIG. 7 is a flowchart illustrating a method of determining the output level of the engine according to the embodiment of the present invention.

The PCM 8 determines the output level of the engine 9 based on an operating state of the engine and an output level map 40 (see FIG. 6). The operating state of the engine 9 is determined based on a fuel injection amount for the engine 9 and an engine speed. The PCM 8 calculates the fuel injection amount, for example, based on the control amounts of the direct injectors 9*m* set at S43 in FIG. 3. The value calculated at S32 in FIG. 3 is used as the engine speed.

FIG. 6 illustrates one example of the output level map 40. The output level map illustrated in FIG. 6 defines ranges of the output level of the engine 9 based on parameters which are the fuel injection amount for the engine 9 and the engine speed. In the output level map 40, the vertical axis indicates the fuel injection amount and the horizontal axis indicates the engine speed. The output level map 40 is stored in the memory of the PCM 8 and includes a first operating range R1 (the range of "low output level" described later), a second operating range R2 (the range of "medium output level" described later), and a third operating range R3 (the range of "high output level" described later).

The output level map 40 can be designed beforehand by experiments, simulations, etc.

Within the first operating range R1, the fuel injection amount is small. When the operating state of the engine 9 is within the first operating range R1, the output level of the engine 9 is low, and thus, a heat release rate of the engine 9 is low. Therefore, the flow rate of the coolant flowed into the cylinder head 9*b* may be low (may be in a state where the flow rate of the coolant flowing through the cylinder head 9*b* is restricted, as described later).

In the following description, the output level of the engine 9 when the operating state of the engine 9 is within the first operating range R1 is referred to as the "low output level." The "low output level" may also be referred to as the "reference output level."

Within the second operating range R2, the fuel injection amount is larger than the first operating range R1. Note that in the example of FIG. 6, a boundary L1 between the first operating range R1 and the second operating range R2 is fixed such that the fuel injection amount is fixed (e.g., fixed at an amount between 30 and 35 $mm^3$/stroke) until the engine speed reaches from zero to a predetermined value (e.g., about 2,400 rpm), and then, within a range where the engine speed exceeds the predetermined value (e.g., 2,400 to 4,400 rpm), the boundary L1 inclines downward to the right such that the fuel injection amount gradually decreases as the engine speed increases. When the operating state of the engine 9 is within the second operating range R2, the heat release rate of the engine 9 is high. Therefore, the flow rate of the coolant flowed into the cylinder head 9*b* needs to be increased so as to suppress the excessive temperature increase of the cylinder head 9*b* (the flow rate restriction needs to be canceled as described later).

In the following description, the output level of the engine 9 when the operating state of the engine 9 is within the second operating range R2 is referred to as the "medium output level."

Within the third operating range R3, the fuel injection amount is larger than the second operating range R2. In the example of FIG. 6, a boundary L2 between the second operating range R2 and the third operating range R3 is fixed such that the fuel injection amount is fixed (e.g., fixed at an amount between 45 and 50 $mm^3$/stroke). When the operating state of the engine 9 is within the third operating range R3, the heat release rate of the engine 9 is higher than the second operating range R2. Therefore, the flow rate of the coolant flowing into the cylinder head 9*b* needs to be increased to be larger than the second operating range R2 so as to suppress the excessive temperature increase of the cylinder head 9*b*.

In the following description, the output level of the engine 9 when the operating state of the engine 9 is within the third operating range R3 is referred to as the "high output level."

Next, the output level determination of the engine 9 performed by the PCM 8 is described with reference to the flowchart of FIG. 7.

First, the PCM 8 performs initial setting on respective parameters (S70). Specifically, the PCM 8 sets to "0" a medium output flag F1 indicating whether the output level of the engine 9 is the medium output level, and sets to "0" a high output flag F2 indicating whether the output level of the engine 9 is the high output level.

The PCM 8 sets to "0" a count value of a first timer for measuring an elapsed period of time since the operating state of the engine 9 enters into the first operating range R1, and sets to "0" a count value of a second timer for measuring an elapsed period of time since the operating state of the engine 9 enters into the second operating range R2, and sets to "0" a count value of a third timer for measuring an elapsed period of time since the operating state of the engine 9 enters into the third operating range R3.

Then, the PCM 8 reads a current fuel injection amount and a current engine speed (S71).

Next, the PCM 8 determines whether the operating state determined based on the read fuel injection amount and engine speed (current operating state) is within the second operating range R2 by referring to the output level map 40 (S72).

If the current operating state is determined to be within the second operating range R2 (S72: YES), the PCM 8 increments the count value of the first timer by one (S73).

Next, the PCM 8 determines whether the count value of the first timer is the same or above a predetermined timer threshold for the first timer (S74).

If the count value of the first timer is determined to be the same or above the predetermined timer threshold (S74: YES), the PCM 8 sets the medium output flag F1 to "1" (S75), which corresponds to determining the output level of the engine 9 as the medium output level. Then, the control returns to S71.

If the count value of the first timer is determined to be below the predetermined timer threshold (S74: NO), the control returns to S71.

If the current operating state is determined to be out of the second operating range R2 (S72: NO), the PCM 8 determines whether the current operating state is within the third operating range R3 by referring to the output level map 40 (S76).

If the current operating state is determined to be within the third operating range R3 (S76: YES), the PCM 8 increments the count value of the second timer by one (S77).

Next, the PCM 8 determines whether the count value of the second timer is the same or above a predetermined timer threshold for the second timer (S78).

If the count value of the second timer is determined to be the same or above the predetermined timer threshold (S78: YES), the PCM 8 sets the high output flag F2 to "1," the medium output flag F1 to "0," and sets the count value of the first timer to "0" (S79), which corresponds to determining the output level of the engine 9 as the high output level. Then, the control returns to S71.

If the count value of the second timer is determined to be below the predetermined timer threshold (S78: NO), the control returns to S71.

If the current operating state is determined to be out of the third operating range R3 (S76: NO), the PCM 8 increments the count value of the third timer by one (S80).

Next, the PCM 8 determines whether the count value of the third timer is the same or above a predetermined timer threshold for the third timer (S801).

If the count value of the third timer is determined to be the same or above the predetermined timer threshold (S801: YES), the PCM 8 sets the medium and high output flags F1 and F2 to "0," and sets the count values of the first and second timers to "0" (resets the count values) (S802), which corresponds to determining the output level of the engine 9 as the low output level. Then, the control returns to S71. On the other hand, if the count value of the third timer is determined to be below the predetermined timer threshold (S801: NO), the control returns to S71.

Figure 8:
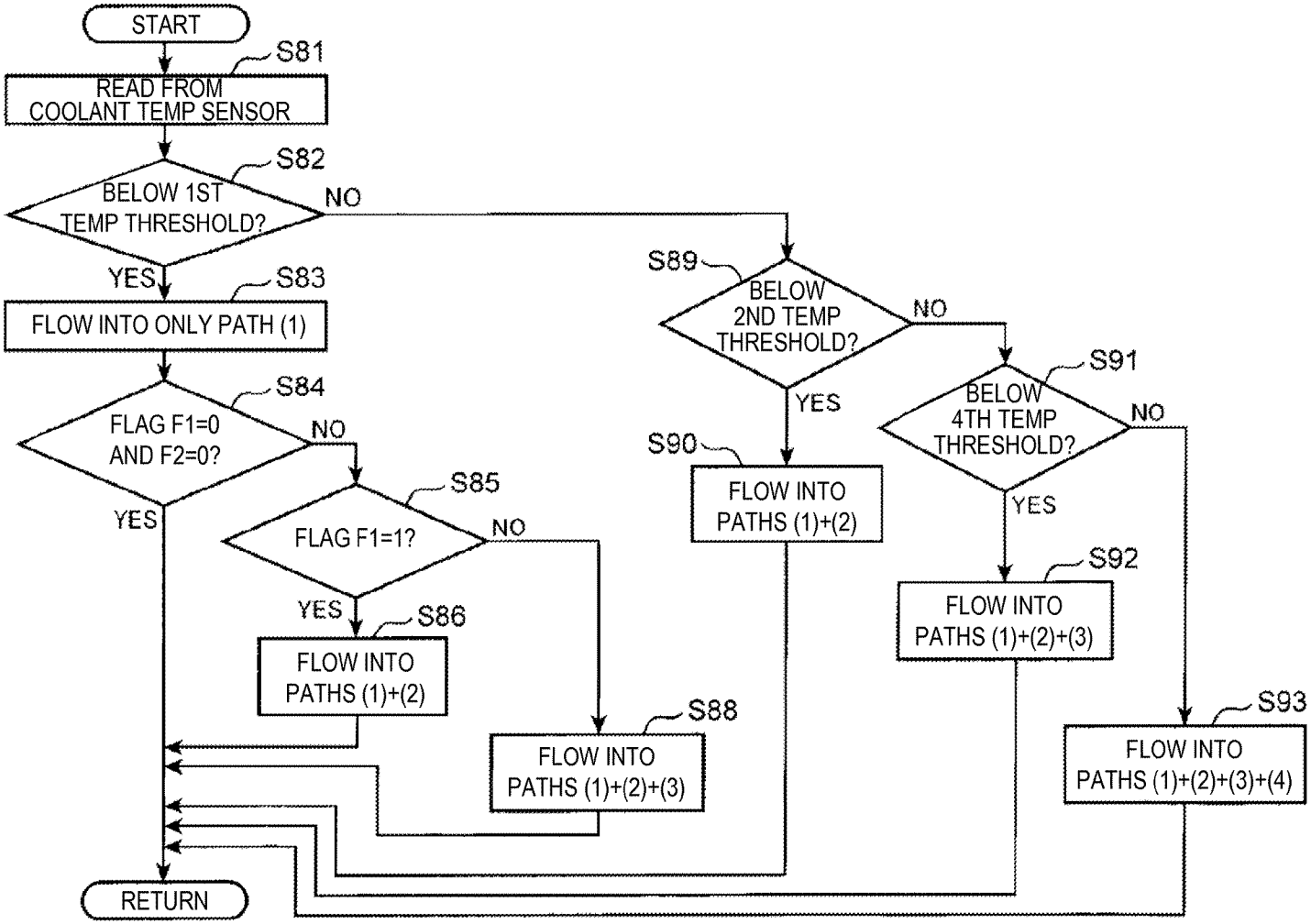
FIG. 8 is a flowchart illustrating a coolant flow switching operation among coolant flow paths according to the embodiment of the present invention.
Figure 9:
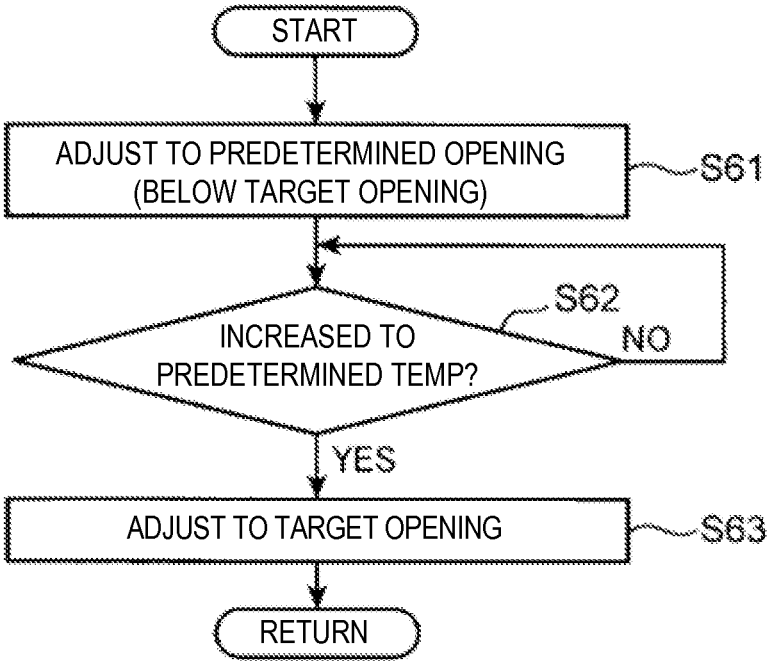
FIG. 9 is a flowchart illustrating an open control of the flow rate control valve according to the embodiment of the present invention.

The control of the flow rate control valve 6 by the PCM 8 (valve control function) is described with reference to the flowcharts of FIGS. 8 and 9.

Note that in the following description, the control is started while the openings of the flow rate control valve 6 with respect to the second and third auxiliary flow paths 3*a* and 3*b* and the third flow path 4 are zero (closed).

First, the PCM 8 receives a temperature T of the coolant near the cylinder head 9*b* from the coolant temperature sensor 7 (S81).

Next, the PCM 8 determines whether the received temperature T is below a first temperature threshold T1 (S82). Here, the first temperature threshold T1 is below a temperature at which the engine 9 transitions from a cold state into a warmed-up state after the cold start (e.g., substantially 80° C.), in other words, a temperature while the engine warms up (before being completely warmed up), for example 50° C. (see FIG. 10).

If the temperature T is determined to be below the first temperature threshold T1 (S82: YES), at S83, the PCM 8 maintains the openings of the flow rate control valve 6 with respect to the second and third auxiliary flow paths 3*a* and 3*b* at zero (see A0 in FIG. 10) so as to restrict the flow rate of the coolant flowing through part of the first flow path 2 on the upstream side of the branch point P1 (hereinafter, referred to as "the upstream flow path 2*b* of the first flow path 2"), in other words, the flow rate of the coolant flowing through the cylinder head 9*b*. Thus, the flow rate of the coolant flowing through the upstream flow path 2*b* of the first flow path 2 becomes equivalent to that flowing through the first auxiliary flow path 2*a* (path (1)), and is controlled to be as small as around zero. Therefore, a temperature decrease of the cylinder head 9*b* is suppressed, and the temperature of the cylinder head 9*b* eventually increases. Note that at S83, the PCM 8 also maintains the opening of the flow rate control valve 6 with respect to the third flow path 4 at zero. Thus, the temperature decrease of the cylinder block 9*a* is suppressed, and the temperature of the cylinder block 9*a* eventually increases.

Next, the PCM 8 determines whether the medium output flag F1 is "0" and the high output flag F2 is "0" (S84).

If the medium output flag F1 is determined as "0" and the high output flag F2 is determined as "0" (S84: YES), which means if the operating state of the engine 9 is within the first operating range R1, the control returns to S81.

On the other hand, if the result of S84 is negative, the PCM 8 determines whether the medium output flag F1 is "1" (S85).

If the medium output flag F1 is determined to be "1" (S85: YES), the control proceeds to S86.

Figure 10:
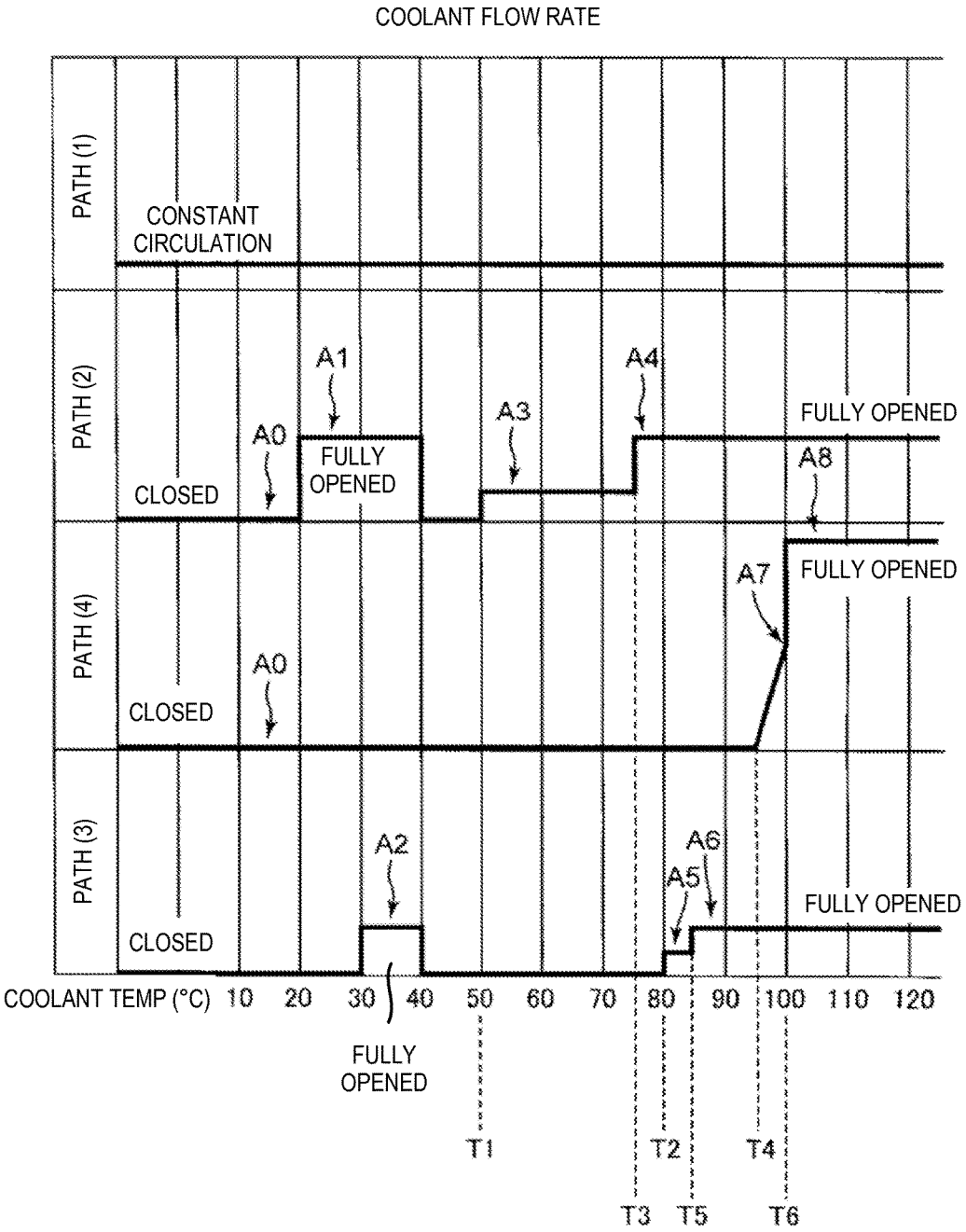
FIG. 10 shows charts illustrating timings of increasing the openings of the flow rate control valve according to the embodiment of the present invention.

At S86, the PCM 8 increases the opening of the flow rate control valve 6 with respect to the second auxiliary flow path 3*a* to the largest opening (fully opened state) to cancel the flow rate restriction of the coolant at the first flow path 2 (see A1 in FIG. 10). Thus, the flow rate of the coolant flowing through the upstream flow path 2*b* of the first flow path 2 is increased. Then, the control returns to S81.

If the medium output flag F1 is determined to not be "1" (S85: NO), the PCM 8 determines that the high output flag F2 is "1," and increases the opening of the flow rate control valve 6 with respect to the third flow path 4 to its largest opening (fully opened state) as indicated by A2 in FIG. 10, while maintaining the opening of the flow rate control valve 6 with respect to the second auxiliary flow path 3*a* at its largest opening (fully opened state) (S88). Then, the control returns to S81.

If the temperature T is determined to be the first temperature threshold T1 or higher (S82: NO), at S89, the PCM 8 determines whether the temperature T is below a second temperature threshold T2 (e.g., 80° C., see FIG. 10). Note that the second temperature threshold T2 is above the first temperature threshold T1.

If the temperature T is determined to be below the second temperature threshold T2 (S89: YES), the PCM 8 increases the opening of the flow rate control valve 6 with respect to the second auxiliary flow path 3*a* to cancel the flow rate restriction of the coolant in the first flow path 2 (S90). Here, a case where the opening of the flow rate control valve 6 with respect to the second auxiliary flow path 3*a* is back to zero from the fully opened state before the determination at S89 is performed, is assumed. Then, the control returns to S81.

Here, the control performed at S90 is described in detail with reference to the flowchart of FIG. 9. First at S61, the PCM 8 adjusts the opening of the flow rate control valve 6 with respect to the second auxiliary flow path 3*a* to reach a predetermined opening which is below a first target opening (e.g., about ⅓ of the first target opening, see A3 in FIG. 10). Note that the "first target opening" used here is a target opening for the warmed-up state, and means a largest opening (fully opened state) of the flow rate control valve 6 with respect to the second auxiliary flow path 3*a*.

Thus, a small amount of coolant starts to flow into the second auxiliary flow path 3*a*, and the coolant flowed through the second auxiliary flow path 3*a* flows into the first flow path 2 via the coolant pump 5. In other words, the flow rate of the coolant flowing through the upstream flow path 2*b* of the first flow path 2 is the sum of the flow rate of the coolant flowing through the first auxiliary flow path 2*a* (path (1)) and the flow rate of the coolant flowing through the second auxiliary flow path 3*a* (path (2)), which means the flow rate increases compared to that at S83. However, since the opening of the flow rate control valve 6 with respect to the second auxiliary flow path 3*a* is not immediately fully opened, but opened to, for example, about ⅓ of the fully opened state, the flow rate restriction of the coolant at the first flow path 2 is started to be gradually canceled.

Then, the PCM 8 determines whether the temperature T detected by the coolant temperature sensor 7 is the same or above a third temperature threshold T3 (e.g., 75° C., see FIG. 10) which is above the first temperature threshold T1 but below the second temperature threshold T2 (S62).

If the temperature T is determined to be the same or above the third temperature threshold T3 (S62: YES), at S63, the PCM 8 adjusts the opening of the flow rate control valve 6 with respect to the second auxiliary flow path 3*a* to reach the first target opening for the warmed-up state (see A4 in FIG. 10). Thus, the flow rate of the coolant flowing through the second auxiliary flow path 3*a* (path (2)) is increased to a target flow rate for the warmed-up state (a largest flow rate for the second auxiliary flow path 3*a*), and accordingly the flow rate of the coolant flowing through the upstream flow path 2*b* of the first flow path 2 is also increased. Since the flow rate is gradually increased in two steps of S61 and S63, the cancelation of the flow rate restriction in the first flow path 2 is gradually performed.

Returning to FIG. 8, if the temperature T is determined to be the second temperature threshold T2 or higher (S89: NO), at S91, the PCM 8 determines whether the temperature T is below a fourth temperature threshold T4 (e.g., 95° C., see FIG. 10). Note that the fourth temperature threshold T4 is above the third temperature threshold T3.

If the temperature T is determined to be below the fourth temperature threshold T4 (S91: YES), the PCM 8 increases the opening of the flow rate control valve 6 with respect to the third flow path 4 (S92). Then, the control returns to S81.

Here, the control performed at S92 is described in detail with reference to the flowchart of FIG. 9. First at S61, the PCM 8 adjusts the opening of the flow rate control valve 6 with respect to the third flow path 4 to reach a predetermined opening which is below a second target opening (e.g., about ½ of the second target opening, see A5 in FIG. 10). Thus, a small amount of coolant starts to flow into the third flow path 4, and the coolant flowed through the third flow path 4 flows into the first and third flow paths 2 and 4 via the coolant pump 5. Note that the "second target opening" used here is a target opening for the warmed-up state, and means a largest opening (fully opened state) of the flow rate control valve 6 with respect to the third flow path 4.

Then, the PCM 8 determines whether the temperature T detected by the coolant temperature sensor 7 is the same or above a fifth temperature threshold T5 (e.g., 85° C., see FIG. 10) which is above the second temperature threshold T2 but below the fourth temperature threshold T4 (S62).

If the temperature T is determined to be the same or above the fifth temperature threshold T5 (S62: YES), at S63, the PCM 8 adjusts the opening of the flow rate control valve 6 with respect to the third flow path 4 to reach the second target opening (see A6 in FIG. 10). Thus, the flow rate of the coolant flowing through the third flow path 4 (path (3)) is increased to a target flow rate for the warmed-up state (a largest flow rate for the third flow path 4). In other words, the flow rate of the coolant flowing out from the third flow path 4 is gradually increased in two steps of S61 and S63.

Returning to FIG. 8, if the temperature T is determined to be the fourth temperature threshold T4 or higher (S91: NO), at S93, the PCM 8 increases the opening of the flow rate control valve 6 with respect to the third auxiliary flow path 3*b*. Then, the control returns to S81.

Here, the control performed at S93 is described in detail with reference to the flowchart of FIG. 9. First at S61, the PCM 8 adjusts the opening of the flow rate control valve 6 with respect to the third auxiliary flow path 3*b* to reach a predetermined opening which is below a third target opening (e.g., about ½ of the third target opening, see A7 in FIG. 10). Note that the "third target opening" used here is a target opening for the warmed-up state, and means a largest opening (fully opened state) of the flow rate control valve 6 with respect to the third auxiliary flow path 3*b*.

Thus, the flow rate of the coolant flowing through the upstream flow path 2*b* of the first flow path 2 increases compared to that at S90. However, since the opening of the flow rate control valve 6 with respect to the third auxiliary flow path 3*b* is not immediately fully opened, but opened to, for example about ½ of the fully opened state, the cancelation of the flow rate restriction of the coolant through the first flow path 2 is gradually performed.

Then, the PCM 8 determines whether the temperature T detected by the coolant temperature sensor 7 is the same or above a sixth temperature threshold T6 (e.g., 100° C., see FIG. 10) which is above the fourth temperature threshold T4 (S62).

If the temperature T is determined to be the same or above the sixth temperature threshold T6 (S62: YES), at S63, the PCM 8 adjusts the opening of the flow rate control valve 6 with respect to the third auxiliary flow path 3*b* to reach the third target opening for the warmed-up state (see A8 in FIG. 10). Thus, the flow rate of the coolant flowing through the third auxiliary flow path 3*b* (path (4)) is increased to a target flow rate for the warmed-up state (a largest flow rate for the third auxiliary flow path 3*b*), and accordingly the flow rate of the coolant flowing through the first flow path 2 is also increased. In other words, since the flow rate is gradually increased in the two steps of S61 and S63, the cancelation of the flow rate restriction in the first flow path 2 is gradually performed.

As described above, according to this embodiment, the output level of the engine 9 is determined based on the fuel injection amount for the engine 9 and the engine speed. The heat release rate of the engine 9 increases as the output level of the engine 9 becomes higher. Further, when the temperature detected by the coolant temperature sensor 7 is below the first temperature threshold T1 and the output level determined by the PCM 8 is the low output level, in other words, when the heat release rate of the engine 9 is low and temperature of the coolant flowing through the cylinder head 9*b* is low, the openings of the flow rate control valve 6 with respect to the second and third auxiliary flow paths 3*a* and 3*b* are zero. Therefore, the flow rate of the coolant flowing through the cylinder head 9*b* is restricted, and the temperature increase of the cylinder head 9*b* is stimulated. Moreover, since the heat release rate of the engine 9 is low, the temperature of the cylinder head 9*b* does not excessively increase even with the restriction of the flow rate of the coolant flowing through the cylinder head 9*b*.

On the other hand, when the temperature detected by the coolant temperature sensor 7 is below the first temperature threshold T1 and the output level determined by the PCM 8 is the medium output level or higher, in other words, when the temperature of the coolant flowing through the cylinder head 9*b* is still low despite that the output level of the engine 9 is higher and the heat release rate of the engine 9 is higher, since the flow rate control valve 6 is opened to the second auxiliary flow path 3*a* is opened, the coolant flows through the second auxiliary flow path 3*a*, the coolant flows into the cylinder head 9*b*, and the coolant flow rate of the cylinder head 9*b* increases.

Specifically, while the temperature of the coolant is low, the coolant flow rate of the engine 9 is only increased when the heat release rate of the engine is high, and therefore, even in a case of sharp acceleration immediately after the cold start of the engine 9 or the vehicle travels at a high speed, the excessive temperature increase of the cylinder head 9*b* can be suppressed while stimulating the temperature increase of the cylinder head 9*b*. Moreover, since the flow rate control valve 6 is fully opened to the second auxiliary flow path 3*a*, the coolant flow rate of the cylinder head 9*b* can swiftly be increased to effectively suppress the excessive temperature increase of the cylinder head 9*b*.

The PCM 8 determines the output level of the engine 9 by referring to the output level map 40. Therefore, the PCM 8 can determine the output level comparatively easily.

The heat release rate of the engine 9 becomes higher as the fuel injection amount becomes larger. Therefore, by determining the output level of the engine 9 based on whether the fuel injection amount is below the fuel injection amount threshold (based on the operating state of the engine 9), the output level can accurately be determined.

The output level of the engine 9 is determined to be the medium output level or higher only when the fuel injection amount continues to exceed the fuel injection amount threshold for the predetermined time period. Therefore, unnecessary cooling of the cylinder head 9*b* due to an increase of the coolant flow rate of the cylinder head can be prevented in a case where the fuel injection amount is momentarily increased, for example.

The heat release rate of the engine 9 per unit time increases as the engine speed increases. Therefore, in the output level map 40, as long as the boundary L1 between the first operating range R1 corresponding to the low output level and the second operating range R2 corresponding to the medium output level inclines such that the fuel injection amount gradually decreases as the engine speed increases, the position of the boundary of the output level of the engine 9 can suitably be set.

After the output level of the engine 9 reaches the medium output level and the coolant is started to be flowed into the second auxiliary flow path 3*a*, when the output level of the engine 9 further increases to reach the high output level, the flow rate control valve 6 is opened to the third flow path 4. Therefore, the cylinder block 9*a* can be cooled. Thus, the heat amount transferred from the cylinder block 9*a* to the cylinder head 9*b* can be reduced and the excessive temperature increase of the cylinder head 9*b* can effectively be suppressed.

The rotary valve with which the coolant flow rate becomes higher as the opening thereof is increased is applied as the flow rate control valve 6. Therefore, the flow rate can easily be controlled.

When the temperature of the coolant flowing through the cylinder head 9*b* is the first temperature threshold T1 or higher, the openings of the flow rate control valve 6 with respect to the second and third auxiliary flow paths 3*a* and 3*b* are increased to the predetermined target openings in the stepwise fashion, respectively. Therefore, the flow rate restriction of the coolant flowing through the cylinder head 9*b* is gradually canceled and the temperature decrease (overcooling) of the cylinder head 9*b* can be suppressed.

Note that in this embodiment, when the output level of the engine 9 reaches the high output level, the flow rate control valve 6 is opened to the third flow path 4; however, it is not limited to this. For example, when the output level of the engine 9 reaches the high output level, the flow rate control valve 6 may be opened (e.g., fully opened) to the third auxiliary flow path 3*b*. By opening the flow rate control valve 6 to the third auxiliary flow path 3*b*, the flow rate of the coolant flowing through the upstream flow path 2*b* of the first flow path 2 increases, and therefore, the excessive temperature increase of the cylinder head 9*b* can effectively be suppressed.

In this embodiment, when the output level of the engine 9 reaches the high output level, the flow rate control valve 6 is opened to the third flow path 4; however, it is not limited to this. For example, when the output level of the engine 9 reaches the high output level, the flow rate control valve 6 may be opened to the third flow path 4 and also to the third auxiliary flow path 3*b*.

In this embodiment, the output level of the engine 9 is defined into three levels; however, it is not limited to this. For example, the output level of the engine 9 may be defined into four or a larger number of levels. Then, for example, a reference output level may be set to the lowest or second-lowest output level among the four or larger number of levels, and when the output level of the engine 9 exceeds the reference output level, the flow rate control valve 6 may be opened to the third flow path 4 and also to the third auxiliary flow path 3*b*.

Similar to S71 to S75, the PCM 8 may count, with a timer, the number of times that the operating state determined based on the fuel injection amount and the engine speed is determined to be within the first operating range R1, and when the count value reaches a predetermined timer threshold, the low output level may be set to "1." In this case, setting the output level to "1" corresponds to determining that the output level of the engine 9 is the low output level.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

DESCRIPTION OF REFERENCE CHARACTERS

1 Cooling System of Engine
2 First Flow Path
2*a* First Auxiliary Flow Path
2*b* Upstream Flow Path
3 Second Flow Path
3*a* Second Auxiliary Flow Path
3*b* Third Auxiliary Flow Path
4 Third Flow Path
5 Coolant Pump
5*a* Input Port of Coolant Pump
5*b* Output Port of Coolant Pump
6 Flow Rate Control Valve
7 Coolant Temperature Sensor
8 PCM
9 Engine
9*a* Cylinder Block
9*b* Cylinder Head
11*a-f* Auxiliary Machinery
11*a* High-pressure EGR Valve
11*b* Intake Shutter Valve
11*c* Low-pressure EGR Cooler
11*d* Low-pressure EGR Valve
11*e* Heater Core
11*f* Radiator
11*g* Oil Cooler
11*h* ATF Cooler
40 Output Level Map

What is claimed is:

1. A cooling system for an engine, comprising: coolant flow paths including a first flow path a second flow path where coolant circulates, the first flow path passing through a cylinder head of the engine, the second flow path branching from the first flow path and passing through an auxiliary machinery of the engine; a coolant pump for circulating the coolant within the coolant flow paths; a flow rate control valve for adjusting a flow rate of the coolant through the second flow path; a temperature detector for detecting a temperature of the coolant within the first flow path; a valve controller for adjusting an opening of the flow rate control valve based on the temperature detected by the temperature detector; and an output level determiner for determining an output level of the engine based on an engine load including at least one of a fuel injection amount for the engine and an engine speed, wherein the output level determiner determines that the output level exceeds a reference output level in a case where the engine load continuously exceeds a predetermined threshold for a predetermined period of time, and the output level determiner determines that the output level is one of the reference output level and a value therebelow in one of a case where the engine load is below the predetermined threshold, and a case where a period of time for which the engine load continuously exceeds the predetermined threshold is shorter than the predetermined time period, wherein, when the engine is warming up, the valve controller adjusts the opening of the flow rate control valve in a first case where the detected temperature is below a predetermined temperature threshold and the determined output level is one of the reference output level and the value therebelow, and adjusts the opening of the flow rate control valve in one of a second case where the detected temperature is below the predetermined temperature threshold and the determined output level exceeds the reference output level, and a third case where the detected temperature is one of the predetermined temperature threshold and a value thereabove, and wherein the opening of the flow rate control valve is closed more in the first case compared to in the second or third case and opened more in the second or third case compared to in the first case.

2. The cooling system of claim 1, wherein the valve controller fully opens the flow rate control valve in the second case where the detected temperature is below the predetermined temperature threshold and the determined output level exceeds the reference output level.

3. The cooling system of claim 2, wherein the output level determiner has an output level map in which ranges of the output level are defined based on parameters, and the output level determiner determines the output level by referring to the output level map, the parameters being the fuel injection amount for the engine and the engine speed.

4. The cooling system of claim 3, wherein the output level map includes a first range including the reference output level and a second range above the first range, and within a range of the output level map where the engine speed exceeds a predetermined value, the boundary between the first and second ranges extends such that the fuel injection amount gradually decreases as the engine speed increases.

5. The cooling system of claim 1, wherein the output level determiner has an output level map in which ranges of the output level are defined based on parameters, and the output level determiner determines the output level by referring to the output level map, the parameters being the fuel injection amount for the engine and the engine speed.

6. The cooling system of claim 5, wherein the output level map includes a first range including the reference output level and a second range above the first range, and within a range of the output level map where the engine speed exceeds a predetermined value, the boundary between the first and second ranges extends such that the fuel injection amount gradually decreases as the engine speed increases.

7. The cooling system of claim 1, wherein the coolant flow paths also include a third flow path passing through a cylinder block of the engine, wherein the flow rate control valve adjusts the flow rate of the coolant through the second and third flow paths, and wherein the valve controller fully closes the flow rate control valve to the third flow path in one of the first case where the detected temperature is below the predetermined temperature threshold and the determined output level is one of the reference output level and the value therebelow, and a fourth case where the detected temperature is below the predetermined temperature threshold and the determined output level is within a range exceeding the reference output level and below a predetermined output level that is above the reference output level, and the valve controller opens the flow rate control valve to the third flow path in one of a fifth case where the detected temperature is below the predetermined temperature threshold and the determined output level is one of the predetermined output level and a value thereabove, and the third case where the detected temperature is one of the predetermined temperature threshold and the value thereabove.

8. The cooling system of claim 7, wherein the flow rate control valve is a rotary valve for increasing the flow rate of the coolant by increasing an opening thereof.

9. The cooling system of claim 1, wherein the flow rate control valve is a rotary valve for increasing the flow rate of the coolant by increasing an opening thereof.

10. A cooling system for an engine, comprising: coolant flow paths including a first flow path and a second flow path where coolant circulates, the first flow path passing through a cylinder head of the engine, the second flow path branching from the first flow path and passing through an auxiliary machinery of the engine; a coolant pump for circulating the coolant within the coolant flow paths; a flow rate control valve for adjusting a flow rate of the coolant through the second flow path; a temperature detector for detecting a temperature of the coolant within the first flow path; a valve controller for adjusting an opening of the flow rate control valve based on the temperature detected by the temperature detector; and an output level determiner for determining an output level of the engine based on at least one of a fuel injection amount for the engine and an engine speed, wherein the valve controller fully closes the flow rate control valve in a case where the detected temperature is below a predetermined temperature threshold and the determined output level is one of a reference output level and a value therebelow, and the valve controller opens the flow rate control valve in one of a case where the detected temperature is below the predetermined temperature threshold and the determined output level exceeds the reference output level, and a case where the detected temperature is one of the predetermined temperature threshold and a value thereabove, wherein the valve controller fully opens the flow rate control valve in the case where the detected temperature is below the predetermined temperature threshold and the determined output level exceeds the reference output level, and wherein the output level determiner has an output level map in which ranges of the output level are defined based on parameters, and the output level determiner determines the output level by referring to the output level map, the parameters being the fuel injection amount for the engine and the engine speed.

11. A cooling system for an engine, comprising: coolant flow paths including a first flow path and a second flow path where coolant circulates, the first flow path passing through a cylinder head of the engine, the second flow path branching from the first flow path and passing through an auxiliary machinery of the engine; a coolant pump for circulating the coolant within the coolant flow paths; a flow rate control valve for adjusting a flow rate of the coolant through the second flow path; a temperature detector for detecting a temperature of the coolant within the first flow path; a valve controller for adjusting an opening of the flow rate control valve based on the temperature detected by the temperature detector; and an output level determiner for determining an output level of the engine based on at least one of a fuel injection amount for the engine and an engine speed, wherein the valve controller fully closes the flow rate control valve in a case where the detected temperature is below a predetermined temperature threshold and the determined output level is one of a reference output level and a value therebelow, and the valve controller opens the flow rate control valve in one of a case where the detected temperature is below the predetermined temperature threshold and the determined output level exceeds the reference output level, and a case where the detected temperature is one of the predetermined temperature threshold and a value thereabove, wherein the coolant flow paths also include a third flow path passing through a cylinder block of the engine, wherein the flow rate control valve adjusts the flow rate of the coolant through the second and third flow paths, and wherein the valve controller fully closes the flow rate control valve to the third flow path in one of the case where the detected temperature is below the predetermined temperature threshold and the determined output level is one of the reference output level and the value therebelow, and a case where the detected temperature is below the predetermined temperature threshold and the determined output level is within a range exceeding the reference output level and below a predetermined output level that is above the reference output level, and the valve controller opens the flow rate control valve to the third flow path in one of a case where the detected temperature is below the predetermined temperature threshold and the determined output level is one of the predetermined output level and a value thereabove, and the case where the detected temperature is one of the predetermined temperature threshold and the value thereabove.

12. The cooling system of claim 11, wherein the output level determiner determines that the output level is one of the reference output level and a value therebelow in a case where the fuel injection amount for the engine is below a predetermined fuel injection amount threshold, and the output level determiner determines that the output level exceeds the reference output level in a case where the fuel injection amount for the engine is one of the fuel injection amount threshold and a value thereabove.

* * * * *